US006059393A

United States Patent [19]

Takahashi

[11] Patent Number: 6,059,393

[45] Date of Patent: May 9, 2000

[54] DRIVING METHOD FOR AN INK EJECTION DEVICE TO ENLARGE PRINT DOT DIAMETER

[75] Inventor: Yoshikazu Takahashi, Nagoya, Japan

[73] Assignee: Brother Kogyo Kabushiki Kaisha, Nagoya, Japan

[21] Appl. No.: 08/705,805

[22] Filed: Aug. 30, 1996

[30] Foreign Application Priority Data

Aug. 31, 1995 [JP] Japan ..... 7-223248

[51] Int. Cl.[7] ..... B41J 29/38

[52] U.S. Cl. ..... 347/11

[58] Field of Search ..... 347/11, 10, 9, 347/5, 20, 68

[56] References Cited

U.S. PATENT DOCUMENTS

| | | | |
|---|---|---|---|
| 3,946,398 | 3/1976 | Keyser et al. . | |
| 4,284,996 | 8/1981 | Greve | 347/11 |
| 4,339,763 | 7/1982 | Kyser et al. . | |
| 4,513,299 | 4/1985 | Lee et al. | 347/11 |
| 4,514,743 | 4/1985 | Roschlein et al. | 347/68 |
| 4,686,539 | 8/1987 | Schmidle et al. | 347/11 |
| 4,716,418 | 12/1987 | Heinzl et al. | 347/11 |
| 4,723,129 | 2/1988 | Endo et al. . | |
| 4,879,568 | 11/1989 | Bartky et al. . | |
| 5,028,936 | 7/1991 | Bartky et al. . | |
| 5,159,349 | 10/1992 | Endo et al. . | |
| 5,285,215 | 2/1994 | Liker | 347/11 |
| 5,371,520 | 12/1994 | Kubota | 347/11 |

*Primary Examiner*—John Barlow
*Assistant Examiner*—Michael S. Brooke
*Attorney, Agent, or Firm*—Oliff & Berridge, PLC

[57] ABSTRACT

In order to enlarge print dot diamter and to obtain an excellent print quality, two droplets are ejected successively at different speeds so that the two droplets merge before individually impinging against a sheet of paper. To this end, a first pulse signal A is applied to an actuator to thereby eject a first droplet at a first speed and thereafter a second pulse signal B is applied thereto to thereby eject a second droplet at a second speed faster than the first speed. The two droplets are merged during flying and the merged droplet forms a print dot on the sheet of paper. The print dot obtained when the flight time was shorter than 100 μsec is larger by 20% than that obtained when the flight time was longer than 100 μsec. The flight time can be adjusted by changing a time difference between the falling edges of the first and second pulse signals A and B.

16 Claims, 8 Drawing Sheets

FIG. 6

| △t(μsec) | DROPLET VOL. (pl) | PRINT DOT DIAMETER (μm) |
|---|---|---|
| 0 | 45 | 135 |
| 20 | 45 | 130 |
| 40 | 45 | 128 |
| 60 | 45 | 128 |
| 80 | 45 | 127 |
| 100 | 45 | 127 |
| 120 | 45 | 105 |
| 140 | 45 | 104 |
| 160 | 45 | 104 |
| 180 | 45 | 103 |
| 200 | 45 | 103 |

DRIVING METHOD FOR AN INK EJECTION DEVICE TO ENLARGE PRINT DOT DIAMETER

BACKGROUND OF THE INVENTION

1. Field of the Invention

The present invention relates to a driving method for an ink ejection device.

2. Description of the Prior Art

Of non-impact type printing devices which have recently taken the place of conventional impact type printing devices and have greatly propagated in the market, ink-ejecting type printing devices have been known as being operated on the simplest principle and as being effectively used to easily perform multi-gradation and coloration. Of these devices, a drop-on-demand type for ejecting only ink droplets which are used for printing has rapidly propagated because of its excellent ejection efficiency and low running cost.

The drop-on-demand types are representatively known as a Kyser type, as disclosed in U.S. Pat. No. 3,946,398, or as a thermal ejecting type, as disclosed in U.S. Pat. No. 4,723,129. The former, or Kyser type, is difficult to design in a compact size. The latter, the thermal ejecting type, requires the ink to have a heat-resistance property because the ink is heated at a high temperature. Accordingly, these devices have significant problems.

A shear mode type printer, as disclosed in U.S. Pat. No. 4,879,568, has been proposed as a new type to simultaneously solve the above disadvantages.

As shown in FIGS. 7(*a*) and 7(*b*), the shear mode type ink ejection device 600 comprises a bottom wall 601, a ceiling wall 602 and a shear mode actuator wall 603 disposed therebetween. The actuator wall 603 comprises a lower wall 607 which is adhesively attached to the bottom wall 601 and polarized in the direction indicated by an arrow 611, and an upper wall 605 which is adhesively attached to the ceiling wall 602 and polarized in the direction indicated by an arrow 609. An ink channel 613 is formed between two adjacent actuator walls 603. A space 615 is formed between next two adjacent actuator walls 603 so that the space 615, which is narrower than the ink channel 613, is formed next to the ink channel 613. In this manner, the ink channel 613 and the space 615 are alternately formed in the widthwise direction of the bottom wall 601 or the ceiling wall 602.

A nozzle plate 617 is fixedly secured to one end of the ink channels 613. The nozzle plate 617 is formed with nozzles 618 so as to positionally correspond to the ink channels 613. An electrode 619 is formed in one side of each actuator wall 603 and an electrode 621 is formed in the other side of the actuator wall 603. Each of the electrodes 619, 621 is formed from a metal. To insulate the metal from the ink, the metal is covered with an insulating material (not shown). The electrodes 619 which face the spaces 615 are connected to ground 623. The electrodes 621 which are provided in the inner side of the ink channel 613 are connected to a silicon chip operating as an actuator driving circuit 625.

Next, a manufacturing method for the ink ejection device 600 as described above will be described. First, a piezoelectric ceramic layer, which is polarized in a direction as indicated by an arrow 611, is adhesively attached to the bottom wall 601 and a piezoelectric ceramic layer, which is polarized in a direction as indicated by an arrow 609, is adhesively attached to the ceiling wall 602. The thickness of the piezoelectric ceramic layer to be attached to the bottom wall 601 and the ceiling wall 602 is equal to the height of the lower walls 607 and the upper walls 605. Subsequently, parallel grooves are formed to the piezoelectric ceramic layers using a diamond cutting disc or the like to form the lower walls 607 and the upper walls 605. Then, the electrodes 619 and 621 are deposited on the side surfaces of the lower walls 607 by a vacuum-deposition method, and the insulating layer is deposited onto the electrodes 619 and 621. Likewise, the electrodes 619 and 621 are deposited on the side surfaces of the upper walls 605 and the insulating layer is deposited on the electrodes 619 and 621.

The vertex portions of the upper walls 605 and the lower walls 607 are adhesively attached to one another to form the ink channels 613 and the spaces 615. Next, the nozzle plate 617 formed with the nozzles 618 therein is adhesively attached to one end of the ink channels 613 and the spaces 615 so that the nozzles 618 positionally correspond to the ink channels 613. The electrode 621 and 619 are connected to the actuator driving circuit 625 and the ground 623, respectively, through the other end of the ink channels 613 and the spaces 615.

A voltage is applied to the electrodes 621 of each ink channel 613 from the actuator driving circuit 625, whereby the actuator walls 603 defining that ink channel 613 suffer a piezoelectric shear mode deflection in such a direction that the volume of the ink channel 613 increases. For example, as shown in FIG. 8, when a voltage V is applied to the electrodes 621*c* of the ink channel 613*c*, an electric field is generated in the actuator wall 603*e* in the direction indicated by arrows 631 and 629 and an electric field is generated in the actuator wall 603*f* in the direction indicated by arrows 632 and 630. Because the electric field directions are at right angles to the polarization directions 609 and 611, the actuator walls 603*e* and 603*f* deform outward to increase the volume of the ink channel 613*c* by the piezoelectric shear effect, resulting in a decrease in the pressure in the ink chamber 613*c*. The negative pressure is maintained for a duration of time a T corresponding to a duration of time during which time pressure wave propagates one way lengthwise in the ink channel 613.

During the time duration T, ink is supplied from a manifold (not shown). The duration of time T is necessary for a pressure wave to propagate across the lengthwise direction of the ink channel. The duration of time T is given by L/a wherein L is the length of the ink channel 613 and a is the speed of sound through the ink filling channel 613. Theories on pressure wave propagation teach that at the moment the duration of time L/a elapses after the rising edge of voltage, the pressure in the ink channel 613 inverts to a positive pressure. The voltage applied to the electrode 621*c* of the ink channel 613*c* is returned to 0 volt in synchronization with the timing when the pressure in the ink channel 613 is inverted so that the actuator walls 603*e*, 603*f* revert to their initial shape shown in FIG. 7(*a*).

The pressure generated when the actuator walls 603*e*, 603*f* return to their initial shape is added to the inverted positive pressure so that a relatively high pressure is generated in the ink channel 613*c*. This relatively high pressure ejects an ink droplet from the nozzle 618*c*. The ink droplet thus ejected impinges upon a recording medium (not shown) spaced, for example, 2 mm, from the nozzle, thereby forming a print dot on the recording medium.

With the conventional driving method of the ink ejection device, it has been unable to adjust the diameter of a print dot to be recorded on the recording medium, because the size of the print dot is determined depending upon the recording medium, ink, the size of ink droplet ejected from the nozzle, and an ink ejection speed. If desirable size of print dot cannot be obtained, a high quality printing cannot be achieved.

SUMMARY OF THE INVENTION

In view of the foregoing, it is an object of the present invention to provide a driving method for an ink ejection device capable of printing with print dots having a desirable size and thus affording an excellent print quality.

An ink ejection device to which the present invention is applied includes walls defining an ink channel, the ink channel having a volume filled with ink and having a length defined by two ends; a nozzle plate attached to one end of the ink channel and formed with a nozzle; an actuator for changing the volume of the ink channel; and control means for applying pulse signals to the actuator.

In accordance with the present invention, a first pulse signal is applied to the actuator, causing ejection of a first ink droplet from the nozzle at a first speed. After ejection of the first ink droplet, a second pulse signal is applied to the actuator, causing ejection of a second ink droplet from the nozzle at a second speed faster than the first speed so that the second ink droplet merges with the first ink droplet before individually impinging against a recording medium held in a predetermined position and that a merged ink droplet impinges against the recording medium within 100 $\mu$sec.

In operation, the volume of the ink channel is increased from a natural volume to an increased volume, causing to generate a pressure wave in the ink filling the ink channel in response to the start edge (rising edge) of the pulse signal, and the volume of the ink chamber reverts to the natural volume, thereby ejecting an ink droplet from the nozzle in response to the termination edge (falling edge) of the pulse signal. In this manner, two ink droplets are successively ejected from the nozzle at different speeds. By adjusting a timing at which the second pulse signal is applied to the actuator, a time duration from merging of the two ink droplets to impingement of the merged ink droplet against the recording medium can be adjusted. Through the adjustment of the time duration or flight time of the merged ink droplet, the merged ink droplet is set to impinge against the recording medium within 100 $\mu$sec. When the flight time is shorter than 100 $\mu$sec, the outer configuration of the merged ink droplet has not yet been matured to a spherical shape but is still in a distorted shape capable of providing a large print dot diameter when printed on the recording medium. Therefore, by setting the flight time to be shorter than 100 $\mu$, printing quality can be improved.

In one embodiment of the present invention, the second pulse signal has a second voltage level higher than a first voltage level of the first pulse signal. The first pulse signal and the second pulse signal have a time duration substantially equal to a predetermined time duration T during which the pressure wave generated in the ink filling the ink channel propagates from one end of the ink channel to the other end of the ink channel in a lengthwise direction of the ink channel.

In another embodiment of the present invention, the second pulse signal has a second voltage level equal to a first voltage level of the first pulse signal, and the second pulse signal has a second time duration longer than a first time duration of the first pulse signal. The first time duration of the first pulse signal is substantially equal to a half of the predetermined time duration T and the second time duration of the second pulse signal is substantially equal to the predetermined time duration T.

According to another aspect of the present invention, the a first pulse signal is applied to the actuator, causing ejection of a first ink droplet from the nozzle at a first speed. After ejection of the first ink droplet, a second pulse signal is applied to the actuator, causing ejection of a second ink droplet from the nozzle at a second speed faster than the first speed so that the second ink droplet merges to the first ink droplet. A merged ink droplet is deformed to have a cross-sectional area in a direction perpendicular to a direction in which the merged ink droplet travels, wherein the cross-sectional area of the merged ink droplet is larger, at least at a time when the second ink droplet merges to the first ink droplet, than a reference cross-sectional area of the merged ink droplet when the merged ink droplet is substantially formed to a spherical shape. A flight time of the merged ink droplet from merging to impingement on the recording medium is determined so that the merged ink droplet having the cross-sectional area larger than the reference cross-sectional area impinges against the recording medium.

BRIEF DESCRIPTION OF THE DRAWINGS

The particular features and advantages of the invention as well as other objects will become more apparent from the following description taken in connection with the accompanying drawings, in which:

FIG. 6 is a table showing droplet volume and print dot diamter measured through experiments while changing a time from merging of the first and second droplets to the arrival at a recording medium;

FIG. 7(*b*) is a plan view showing the ink ejection device shown in FIG. 7(*a*)

DETAILED DESCRIPTION OF THE PREFERRED EMBODIMENTS

Preferred embodiments of the present invention will be described with reference to the accompanying drawings.

Figure 2:
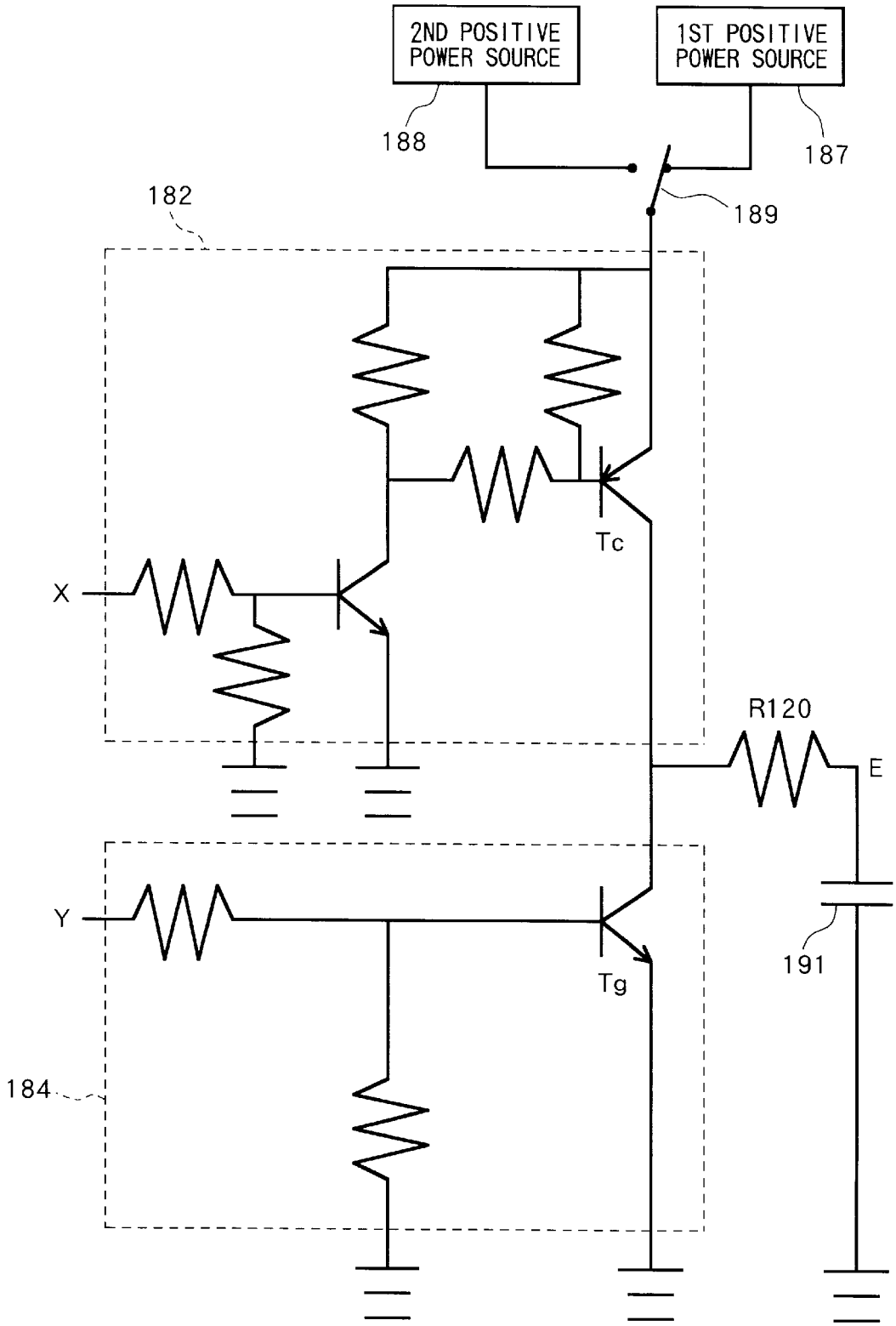
FIG. 2 is a circuit diagram showing a driving circuit for generating the voltage waveforms shown in FIG. 1.
Figure 7:
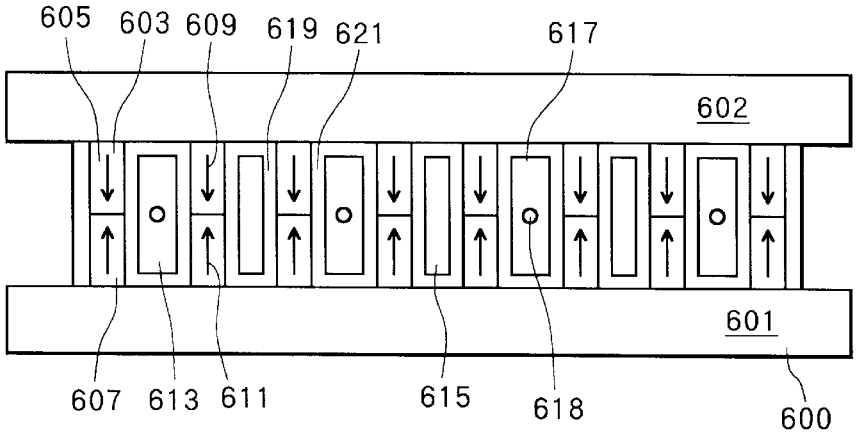
FIG. 7 (a) PRIOR ART
FIG. 7(*a*) is a cross-sectional view showing a conventional ink ejection device, to which the present invention is applied.
Figure 7:
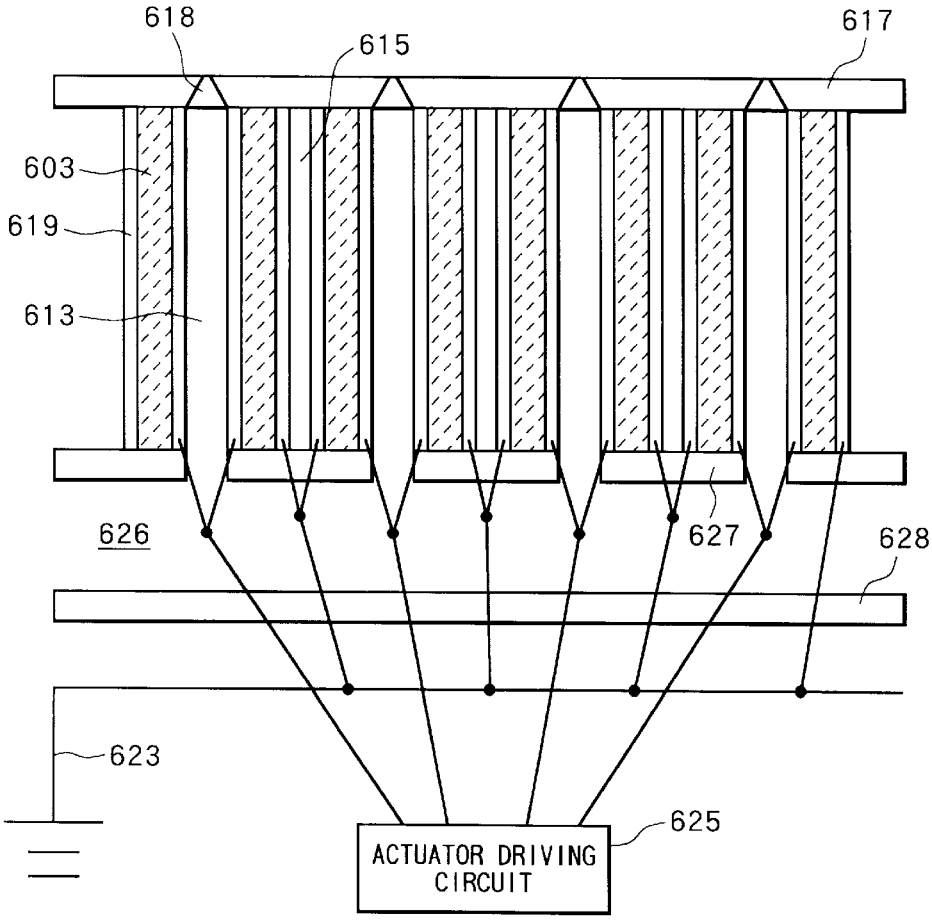
FIG. 7 (b) PRIOR ART
Figure 8:
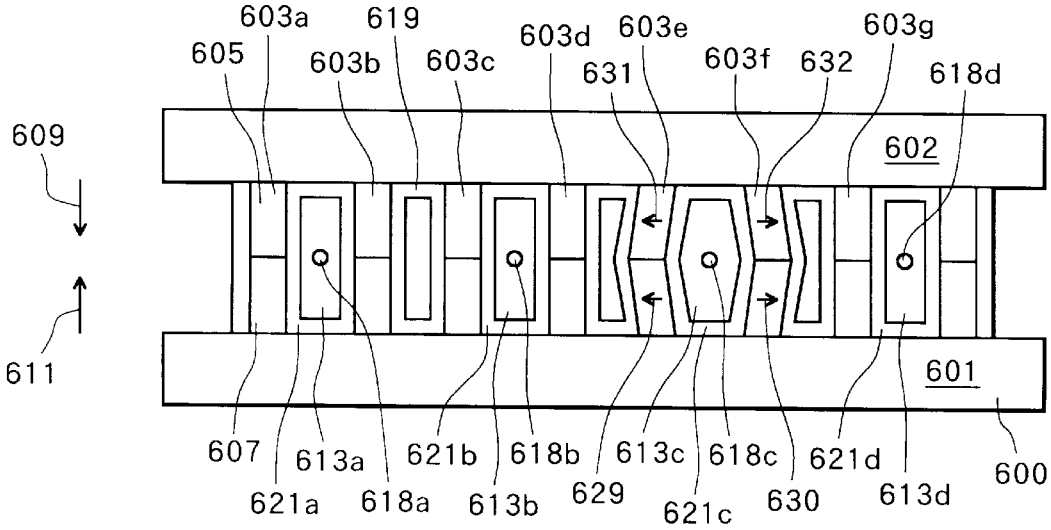
FIG. 8 PRIOR ART
FIG. 8 is a cross-sectional view illustrating an operation of the ink ejection device shown in FIGS. 7(*a*) and 7(*b*).

The present invention is applied to an ink ejection device 600 shown in FIGS. 7(*a*) and 7(*b*). Therefore, the description of the ink ejection device 600 will not be repeated here. A circuit arrangement of the actuator driving circuit 625 as used in the embodiment of the present invention is shown in FIG. 2. Although not shown in FIG. 2, a microcomputer is connected to the actuator driving circuit 625 for applying input signals X and Y to the actuator driving circuit 625 in a prescribed sequential relation.

Dimensions of the ink ejection device according to the present embodiment will be described. The length L of the ink channel 613 is 7.5 mm. The diameter of the nozzle 618 on the outer side of the nozzle plate 617 is 40 μm, the diameter of the nozzle 618 on the inner side of the nozzle plate 617 is 72 μm, and the length of the nozzle is 100 μm. The ink used in the experiments has a viscosity of 2 mpa.s, and the surface tension of 30 mN/m. A ratio of the ink channel length L to the sound velocity a, i.e., L/a, is 8 μsec. The ratio L/a represents a time duration T required for a pressure wave generated in the ink filling the ink channel 613 to propagate from one end of the ink channel 613 to the other end of the ink channel 61 in a lengthwise direction of the ink channel.

Figure 1:
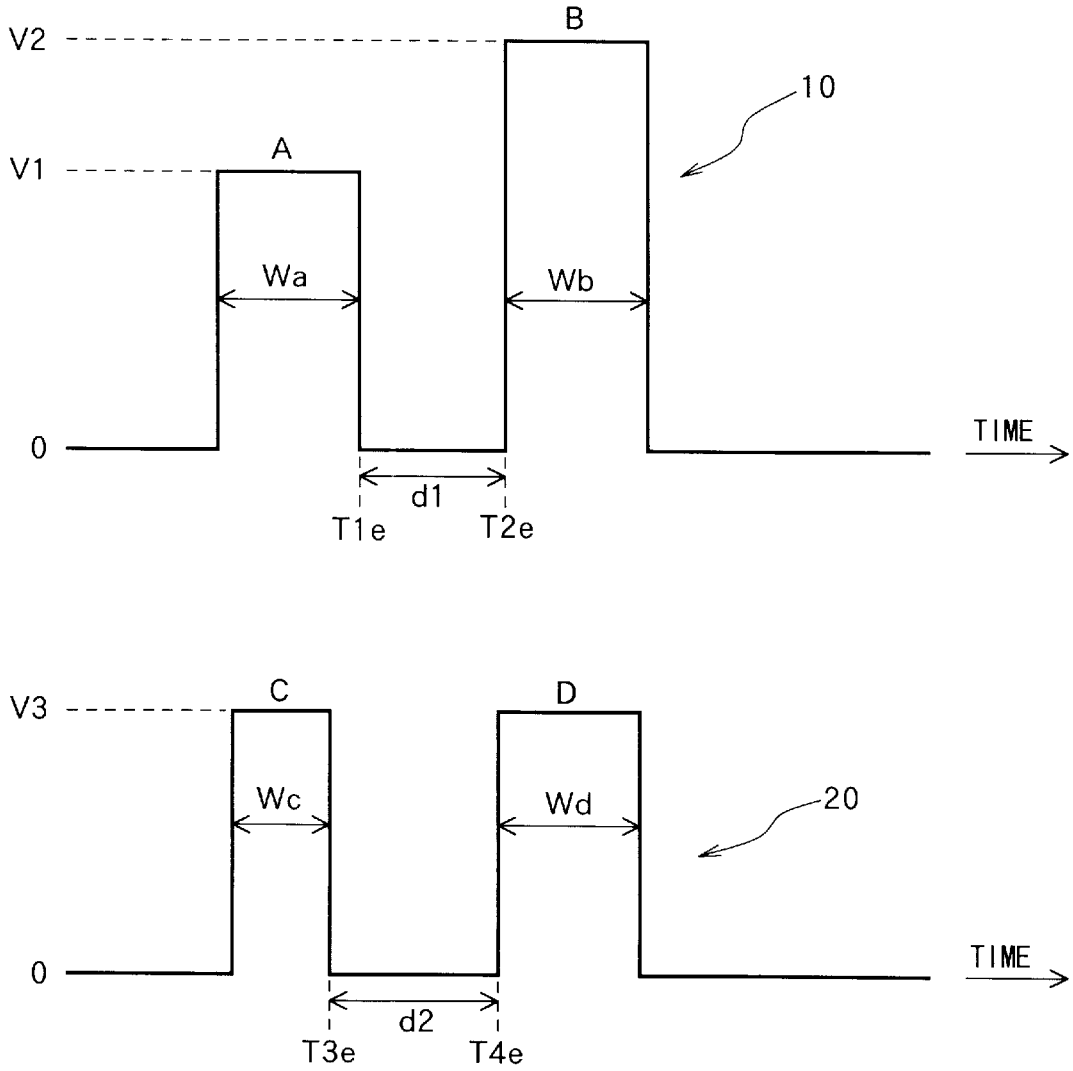
FIG. 1 is a diagram illustrating voltage waveforms for driving an ink ejection device according to an embodiment of the present invention.

FIG. 1 shows two types of driving waveforms to be applied to the electrodes 621 of the ink channel 613. The first driving waveform 10 includes first pulse signal A and second pulse signal B. The crest value or voltage level of the first pulse signal A is V1 (for example, 20 volts) and that of the second pulse signal B is V2 (for example, 23 volts) higher than V1. The two pulse signals A and B serve to eject ink droplets. The width or time duration Wa of the first pulse signal A and also the time duration Wb of the second pulse signal B are equal to the time duration T (=L/a). That is, the durations Wa and Wb of the first and second pulse signals A and B are 8 μsec. A time difference d1 between timings T1e and T2e, that is, between the falling edges of the first and second pulse signals A and B, is 2.5 times as long as the time duration T, i.e., 20 μsec.

The second driving waveform 20 includes third pulse signal C and fourth pulse signal D. The third and fourth pulse signals C and D have the same voltage level V3 (for example, 20 volts). The two pulse signals C and D also serve to eject ink droplets. The time duration Wc of the third pulse signal C is a half of the time duration T, i.e., 4 μsec. The time duration Wd of the fourth pulse signal D is equal to the time duration T, i.e., 8 μsec. A time difference d2 between timings T3e and T4e, that is, between the falling edges of the third and fourth pulse signals C and D is 2.5 times as long as the time duration T, i.e., 20 μsec.

FIG. 2 is a circuit diagram of the actuator driving circuit 625 shown in FIG. 7(*b*), in which first and second positive power sources 187 and 188 are used. The circuit shown in FIG. 2 selectively produces V volts and zero volt to be applied to the electrodes 621 of the ink channels 613 in response to input signals X and Y. When the input signal X is rendered ON and the input signal Y is rendered OFF, then the V volts is applied to a capacitor 191 whereas when the input signal Y is rendered ON and the input signal X is rendered OFF, zero volt is applied to the capacitor 191. The actuator wall 603 and the electrodes 619 and 621 at both sides thereof form the capacitor 191.

The actuator driving circuit shown in FIG. 2 is formed from two blocks surrounded by broken lines. One block designated by reference numeral 182 indicates a charge circuit for charging the capacitor 191 and another block designated by reference numeral 184 indicates a discharge circuit for discharging the capacitor 191. When the input signal X is rendered ON, a transistor Tc in the charge circuit 182 is rendered conductive, so that V1 volts (for example, 20 V) is applied to the electrode E of the capacitor 191 through a resistor R120 from the first positive power source 187. To change the voltage to be applied to the electrode E of the capacitor 191, a change-over switch 189 is operated to connect the emitter of the transistor Tc to the second positive power source 188 which supplies V2 volts (for example, 23 volts). When the input signal Y is rendered ON, a transistor Tg in the discharge circuit 184 is rendered conductive, so that the electrode E of the capacitor 191 is connected to ground through the resistor R120.

Figure 3:
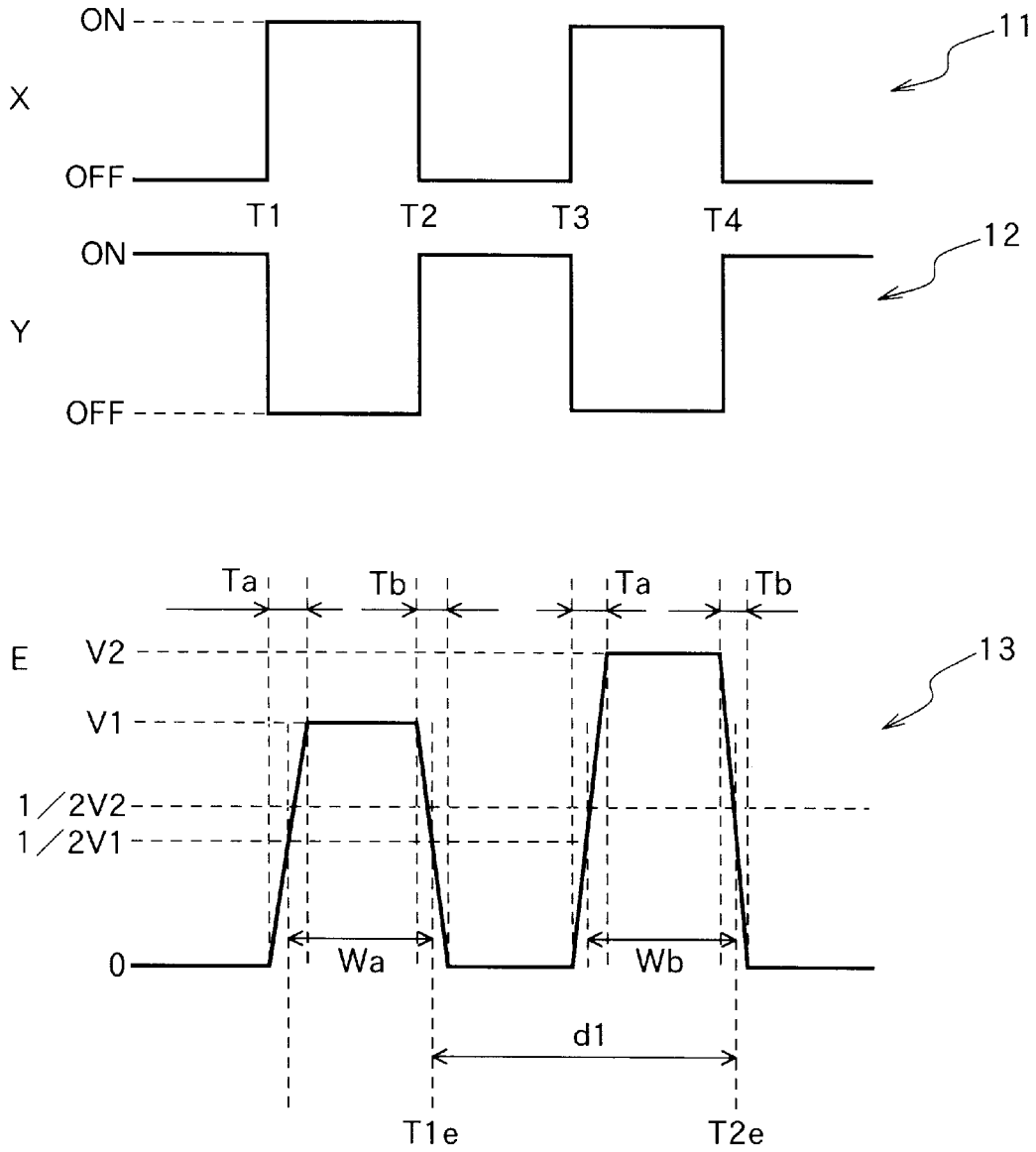
FIG. 3 is a timing chart illustrating a driving method according to one embodiment of the present invention.
Figure 4:
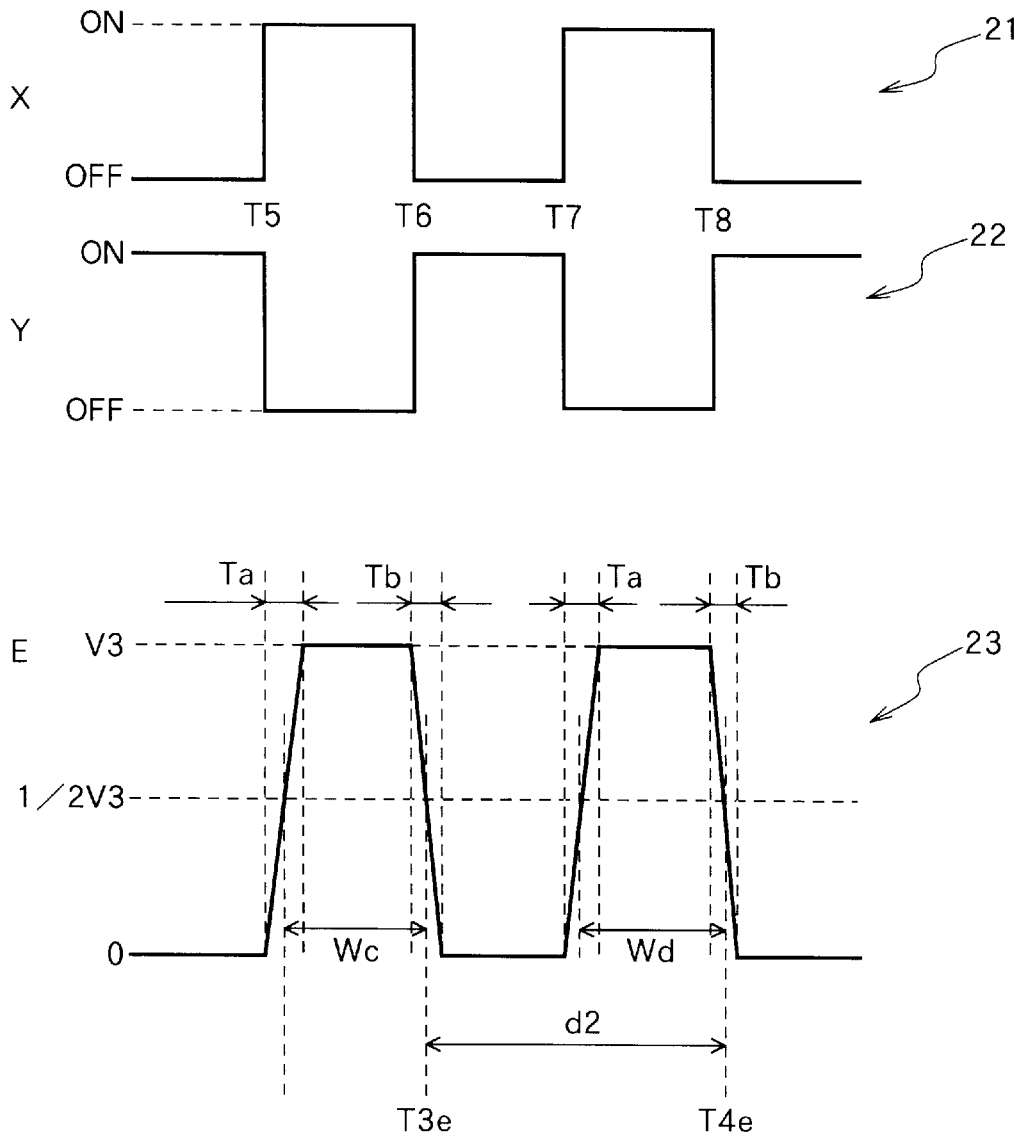
FIG. 4 is a timing chart illustrating a driving method according to another embodiment of the present invention.

FIG. 3 shows timing charts 11 and 12 of the input signals X and Y for generating the first driving waveform 10 and also a voltage waveform 13 appearing at the electrode E of the capacitor 191. FIG. 4 shows timing charts 21 and 22 of the input signals X and Y for generating the second driving waveform 20 and also a voltage waveform 23 appearing at the electrode E of the capacitor 191.

As shown in FIGS. 3 and 4, the phase of the input signal X is in an inverse relation to that of the input signal Y. These input signals X and Y are supplied from the microcomputer (not shown). As shown in FIGS. 3 and 4, the input signal X is normally at a low level (OFF) and is rendered high (ON) at a predetermined timing T1 or T5, and rendered low (OFF) at timing T2 or T6. Thereafter, the input signal X is again rendered high at timing T3 or T7, and rendered low at timing T4 or T8.

For the first driving waveform 10, the voltage 13 appearing at the electrode E of the capacitor 191 is normally at 0 volt but is raised to V1 volts (for example, 20 volts) after expiration of a charging duration Ta determined by the transistor Tc, the resistor R120 and the capacitor 191 from timing T1 at which the capacitor 191 starts charging. At timing T2, the capacitor 191 starts discharging and the voltage at the electrode E of the capacitor 191 falls to 0 volt after expiration of a discharging duration Tb determined by the transistor Tg, the resistor R120 and the capacitor 191 from the timing T2. Subsequently, the capacitor 191 again starts charging at timing T3, and after expiration of the charging duration Ta from the timing T3, the voltage at the electrode E of the capacitor 191 becomes V2 voltage (for example, 23 volts). At timing T4, the capacitor 191 starts discharging. After expiration of the discharging duration Tb from the timing T4, the voltage at the electrode E again turns to 0 volt.

As described, with the circuit shown in FIG. 2, a time interval Ta is needed for rising up the voltage of the actual driving waveform 10 from 0 volt to V1 or V2 volts, and a time interval Tb is needed for falling down the voltage from V1 or V2 volts to 0 volt. Therefore, timings T1 through T4 must be determined so that the duration Wa of the first pulse signal A as measured on the voltage level of ½.V1 (for example, 10 volts), the duration Wb of the second pulse signal B as measured on the voltage level of ½.V2, and the time difference d1 from the falling edge of the first pulse signal A to the falling edge of the second pulse signal B, are in coincidence with the predetermined values as described above.

For the second driving waveform 20, the voltage 23 appearing at the electrode E of the capacitor 191 is normally at 0 volt but is raised to V3 volts (for example, 20 volts) after expiration of the charging duration Ta from timing T5 at which the capacitor 191 starts charging. At timing T6, the capacitor 191 starts discharging and the voltage at the electrode E of the capacitor 191 falls to 0 volt after expiration of the discharging duration Tb from the timing T6. Subsequently, the capacitor 191 again starts charging at timing T7, and after expiration of the charging duration Ta from the timing T7, the voltage at the electrode E of the capacitor 191 becomes V3 voltage (for example, 20 volts). At timing T8, the capacitor 191 starts discharging. After expiration of the discharging duration Tb from the timing T8, the voltage at the electrode E again turns to 0 volt.

The time interval Ta is needed for rising up the voltage of the actual driving waveform 120 from 0 volt to V3, and the time interval Tb is needed for falling down the voltage from V3 volts to 0 volt. Therefore, timings T5 through T8 must be determined so that the duration Wc of the third pulse signal C, the duration Wb of the fourth pulse signal D, and the time difference d1 from the falling edge of the third pulse signal C to the falling edge of the fourth pulse signal D as measured on the voltage level of ½.V3, are in coincidence with the predetermined values as described above.

Figure 5:
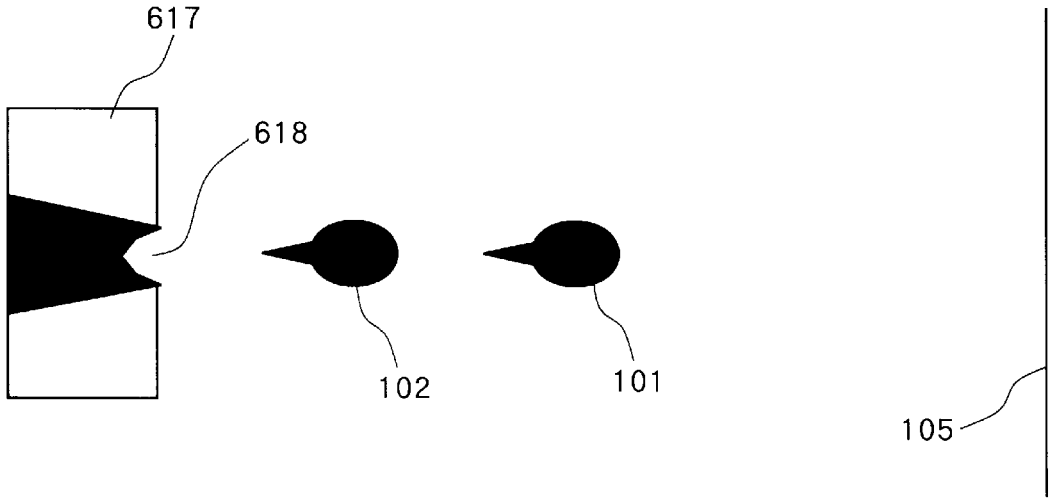
FIGS. 5(*a*) and 5(*b*) are schematical diagrams illustrating ejection of ink droplets according to the driving method according to the embodiments of the present invention.
Figure 5:
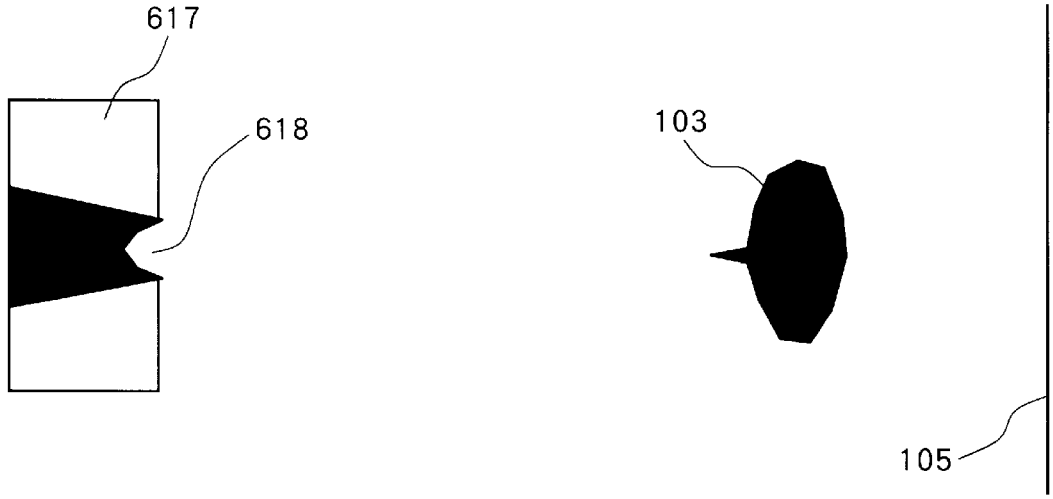

Ink ejection tests were performed with the driving waveforms 10 and 20 as described above. The driving voltages V1 and V3 were set to 20 volts, and the driving voltage V2 was set to 23 volts. In the test performed with the first driving waveform 10, a liquid droplet 101 was ejected in response to the first pulse signal A and subsequently another liquid droplet 102 was ejected in response to the second pulse signal B as shown in FIG. 5(*a*). Because the driving voltage of the second pulse signal B is higher than that of the first pulse signal A, the ejection speed of the secondly ejected droplet 102 is faster than that of the firstly ejected droplet 101. During the flight time, the secondly ejected droplet 102 merged with the firstly ejected one droplet 101 and the resultant merged ink droplet 103 impinged against a sheet of paper 105 and a print dot is printed thereon, as shown in FIG. 5(*b*).

The test was also performed with respect to the second driving waveform 20. Likewise, after ejecting a liquid droplet 101 in response to the third pulse signal C, another liquid droplet 102 was ejected in response to the fourth pulse signal D as shown in FIG. 5(*a*). Because the duration Wc of the third pulse signal C is shorter than the time duration T, the pressure applied to ink at the time of ejection of the first droplet 101 is not as high as that applied to ink at the time of ejection of the second droplet 102. Therefore, the ejection speed of the first droplet 101 is slower than that of the second droplet 102. During the flight time, the second droplet 102 merged with the first droplet 101 and the resultant droplet 103 impinged against the sheet of paper 105 as shown in FIG. 5(*b*).

When the first driving waveform 10 is used, it is possible to change the flight time of the merged ink droplet 103 by changing the time difference d1 between the falling edge of the first pulse signal A at timing T1e and the falling edge of the second pulse signal B at timing T2e. When the second driving waveform 20 is used, the flight time of the merged ink droplet 103 can also be changed by changing the time difference d2 between the falling edge of the third pulse signal C at timing T3e and the falling edge of the fourth pulse signal D at timing T4e.

The volume of merged ink droplet 103 and the diameter of the print dot on the sheet of paper were measured while changing the flight time of the merged ink droplet 103. The same results were obtained for both the first and second driving waveforms 10 and 20 and are shown in FIG. 6. The volume of the merged droplet 103 was 45 pl regardless of the change in the flight time from merging of two droplets 101 and 102 to impingement of the merged droplet 103 against the sheet of paper 105. However, the test results indicate that the diameter of the printed dot obtained when the flight time was shorter than 100 μsec is larger by 20% than that obtained when the flight time was longer than 100 μsec. When the flight time is shorter than 100 μsec, the outer configuration of the merged ink droplet 103 has not yet been matured to a spherical shape but is still in a distorted shape. A large print dot diameter results from this distorted outer configuration of the merged ink droplet 103. Therefore, by setting the flight time to be shorter than 100 μsec, printing quality will be improved.

More specifically, the merged ink droplet 103 is deformed to have a cross-sectional area in a direction perpendicular to a direction in which the merged droplet travels. The cross-sectional area of the merged ink droplet 103 is larger, at least at a time when the second ink droplet 102 merges to the first ink droplet 101, than a reference cross-sectional area of the merged ink droplet 103 when substantially formed to a spherical shape. In the present invention, a flight time of the merged ink ink droplet 103 from merging to impingement on the recording medium is determined so that the merged ink droplet 103 having the cross-sectional area larger than the reference cross-sectional area impinges against the recording medium 105.

While exemplary embodiments of this invention have been described in detail, those skilled in the art will recognize that there are many possible modifications and variations which may be made in these exemplary embodiments while yet retaining many of the novel features and advantages of the invention. For example, although the positive power sources 187 and 188 were used in the above described embodiment, negative power sources can be used if the polarization directions 609 and 611 of the piezoelectric element shown in FIG. 7(*a*) are inverted.

Further, spaces 615 provided between the ink channels 613 can be dispensed with. In this case, ink channels are arranged in side-by-side fashion. In addition, although in the above embodiment, the volume of the ink channel 613 is changed by deforming both the lower part 607 and the upper part 605 of the actuator wall 603, either the upper part or the lower part 607 may deform to produce this effect.

What is claimed is:

1. A method of driving an ink ejection device that includes walls defining an ink channel, the ink channel having a volume filled with ink and having a length defined by two ends, a nozzle plate attached to one end of the ink channel and formed with a nozzle, an actuator coupled to each of the walls for changing the volume of the ink channel, and control means for applying pulse signals to the actuator, the method comprising the steps of:

(a) applying a first pulse signal to the actuator, causing ejection of a first ink droplet from the nozzle at a first speed; and (b) after ejection of the first ink droplet, applying a second pulse signal to the actuator, causing ejection of a second ink droplet from the nozzle at a second speed faster than the first speed so that the second ink droplet merges with the first ink droplet before individually impinging against a recording medium held in a predetermined position and that a merged ink droplet impinges against the recording medium within 100 μsec of merger, whereby a diameter of a point dot on the recording medium is substantially maximized for a given volume of ink.

2. The method according to claim 1, further comprising the step of adjusting a timing at which the second pulse signal is applied to the actuator to have the merged ink droplet impinge against the recording medium within 100 μsec.

3. The method according to claim 2, further comprising the step of adjusting a time interval between a termination edge of the first pulse signal and a termination edge of the second pulse signal to have the merged ink droplet impinge against the recording medium within 100 μsec.

4. The method according to claim 1, further comprising the step of adjusting a second voltage level of the second pulse signal to be higher than a first voltage level of the first pulse signal.

5. The method according to claim 4, further comprising the step of setting a time interval duration of the first pulse signal and the second pulse signal substantially equal to a predetermined time duration during which a pressure wave generated in the ink filling the ink channel propagates from one end of the ink channel to another end of the ink channel in a lengthwise direction of the ink channel.

6. The method according to claim 5, further comprising the step of supplying the control means with a first power source and a second power source, the first and the second power sources supplying different voltages.

7. The method according to claim 1, further comprising the steps of:

setting a second voltage level for the second pulse signal equal to a first voltage level of the first pulse signal; and setting a second time duration for the second pulse signal longer than a first time duration of the first pulse signal.

8. The method according to claim 7, further comprising the step of setting the first time duration of the first pulse signal substantially equal to a half of a predetermined time duration and the second time duration of the second pulse signal substantially equal to the predetermined time duration, wherein during the predetermined time duration a pressure wave generated in the ink filling the ink channel propagates from one end of the ink channel to another end of the ink channel in a lengthwise direction of the ink channel.

9. The method according to claim 8, further comprising the step of supplying the control means with a single power source.

10. The method according to claim 1, further comprising the step of applying the pulse signals to the actuator, wherein the actuator is in a form of a wall defining the ink channel, at least a portion of the actuator being formed from a piezoelectric material.

11. The method according to claim 10, further comprising the step of operating the piezoelectric material in a shear mode.

12. A method of driving an ink ejection device that includes walls defining an ink channel, the ink channel having a volume filled with ink and having a length defined by two ends, a nozzle plate attached to one end of the ink channel and formed with a nozzle, an actuator coupled to each of the walls for changing the volume of the ink channel, and control means for applying pulse signals to the actuator, the method comprising the steps of:

(a) applying a first pulse signal to the actuator, causing ejection of a first ink droplet from the nozzle at a first speed; and (b) after ejection of the first ink droplet, applying a second pulse signal to the actuator, causing ejection of a second ink droplet from the nozzle at a second speed faster than the first speed so that the second ink droplet merges with the first ink droplet prior to impingement of the first ink droplet on a recording medium, a merged ink droplet being deformed to have a cross-sectional area in a direction perpendicular to a direction in which the merged ink droplet travels, wherein a flight time of the merged ink droplet from merger to impingement on the recording medium is less than 100 $\mu$sec so that the cross-sectional area of the merged ink droplet is larger than a reference cross-sectional area of the merged ink droplet when the merged ink droplet is substantially formed in a spherical shape to maximize a diameter of a point dot on the recording medium for a given volume of ink.

13. The method according to claim 12, further comprising the step of adjusting a timing at which the second pulse signal is applied to the actuator to determine the flight time of the merged ink droplet.

14. The method according to claim 13, further comprising the step of adjusting a time interval between a termination edge of the first pulse signal and a termination edge of the second pulse signal to determine the flight time of the merged ink droplet.

15. The method according to claim 12, further comprising the step of setting a second voltage level of the second pulse signal to be higher than a first voltage level of the first pulse signal.

16. The method according to claim 12, further comprising the steps of:

setting a second voltage level equal to a first voltage level of the first pulse signal; and setting a second time duration longer than a first time duration of the first pulse signal.

* * * * *